United States Patent [19]

Marsden

[11] 4,224,878

[45] Sep. 30, 1980

[54] HOPPER CAR DOOR LOCKING MECHANISM

[75] Inventor: Dennis B. Marsden, Griffith, Ind.

[73] Assignee: Pullman Incorporated, Chicago, Ill.

[21] Appl. No.: 916,396

[22] Filed: Jun. 16, 1978

[51] Int. Cl.[2] ..... B61D 7/02; B61D 7/18; B61D 7/24

[52] U.S. Cl. ..... 105/253; 105/308 E; 105/308 P

[58] Field of Search ..... 105/253, 280, 283, 308 E, 105/308 P, 308 R

[56] References Cited

U.S. PATENT DOCUMENTS

| | | | |
|---|---|---|---|
| 900,672 | 10/1908 | Egan | 105/308 R |
| 1,270,005 | 6/1918 | Clark | 105/308 R X |
| 1,431,507 | 10/1922 | Wine | 105/308 R |
| 1,633,762 | 6/1927 | Campbell et al. | 105/308 R |
| 1,729,375 | 9/1929 | Ellis et al. | 105/308 E |
| 1,798,184 | 3/1931 | Wasberg et al. | 105/308 E |
| 1,830,389 | 11/1931 | Ellis et al. | 105/308 E |
| 2,720,174 | 10/1955 | Dorey | 105/308 R |
| 2,730,966 | 1/1956 | Dorey | 105/308 P |
| 2,891,487 | 6/1959 | Hankins | 105/308 P |
| 3,121,403 | 2/1964 | Smith | 105/308 P X |
| 3,149,582 | 9/1964 | Madland | 105/253 |
| 3,240,166 | 3/1966 | Floehr | 105/308 R |
| 3,837,294 | 9/1974 | Fossett | 105/308 P |

*Primary Examiner*—John J. Love
*Assistant Examiner*—Howard Beltran
*Attorney, Agent, or Firm*—Richard J. Myers

[57] ABSTRACT

The locking mechanism comprises a clevis arrangement on a hopper door which is engaged by a jaw positioned centrally on a hopper structure. A locking bar is provided which extends to the outer edge of the hopper structure and is connected to rotate with a locking plate which is manually actuated. A safety pawl is provided to prevent inadvertent rotation of the locking plate.

11 Claims, 7 Drawing Figures

HOPPER CAR DOOR LOCKING MECHANISM

BACKGROUND OF THE INVENTION

1. Field of the Invention

The present arrangement relates to hopper car discharge mechanisms and more specifically it relates to hoppers with discharge openings extending laterally below the hopper car and including doors with locking mechanisms for discharging material from the car into bin areas which may be located beneath the railroad track.

2. Description of the Prior Art

U.S. Pat. No. 900,672 is of interest for its disclosure of a locking device for a door or hinged hopper bottom. U.S. Pat. Nos. 1,729,375 and 1,830,389 are of interest for their disclosure of an over center door latching arrangement. U.S. Pat. No. 1,798,184 is of interest for its disclosure of a toggle locking arrangement for a hopper car. U.S. Pat. No. 2,891,487 is of interest for its disclosure of a hopper door locking mechanism. U.S. Pat. No. 3,121,403 is of interest for its disclosure of a hopper door locking mechanism wherein sticking of the device is avoided by providing lost motion between the parts. U.S. Pat. No. 3,149,582 is of interest for its disclosure of a locking device for hopper car doors. U.S. Pat. No. 3,240,166 is of interest for its disclosure of a locking mechanism for railway car hopper doors. U.S. Pat. Nos. 2,720,174 and 2,730,966 are of interest for their disclosure of various types of hopper door latching mechanisms. U.S. Pat. No. 3,327,294 is of interest for its disclosure of a cam operated hopper gate latching mechanism.

SUMMARY OF THE INVENTION

The present invention pertains to a railroad hopper car of a type which is in many instances utilized for carrying and discharging material such as coal. In cars of this type the top is usually open and the car comprises a plurality of hoppers which are provided with hopper portions extending below the car and being provided with transversely extending outlet or discharge openings. The doors are normally closed by locking mechanisms which when released permit the doors to swing outwardly by gravity and thus accommodate discharge of the load from the hoppers. In many of the designs of the prior art these doors are manually locked by locking mechanisms which in response to actuation of pry bars will provide secure locking and unlocking of the car doors.

The disclosed construction comprises a door which is provided at its lower end with a hinge bracket hingedly supporting the clevis type of latching bar having a transversely extending latch element adapted to be engaged in the jaw of a locking arrangement. The locking arrangement comprises a locking bar which is supported on the hopper structure and extends transversely outwardly adjacent to one end of the depending hopper structure which is projecting downwardly fron underneath the hopper car. The bar is pivotally supported on a suitable outer bracket and has connected thereto at one end a locking plate which is pivotally movable with the bar. The locking plate is provided with a notch portion adapted to be engaged by the nose of a safety pawl for maintaining the mechanism in a closed position. In this position the jaw in its engagement with the clevis has moved the doors to the closed position and upon further rotation of the locking bar and operating rod the locking plate and the jaw are further moved to an over-center locked position. In this over-center locked position the pawl also has moved into engagement with one side of the locking plate and prevents any inadvertent rotation to an unlocked position. The rotation of the locking plate is effectuated by the manual insertion of a bar between outwardly projecting portions of the locking rod end and actuating bar portion provided on the locking plate.

DESCRIPTION OF THE PREFERRED EMBODIMENT

Figure 1:
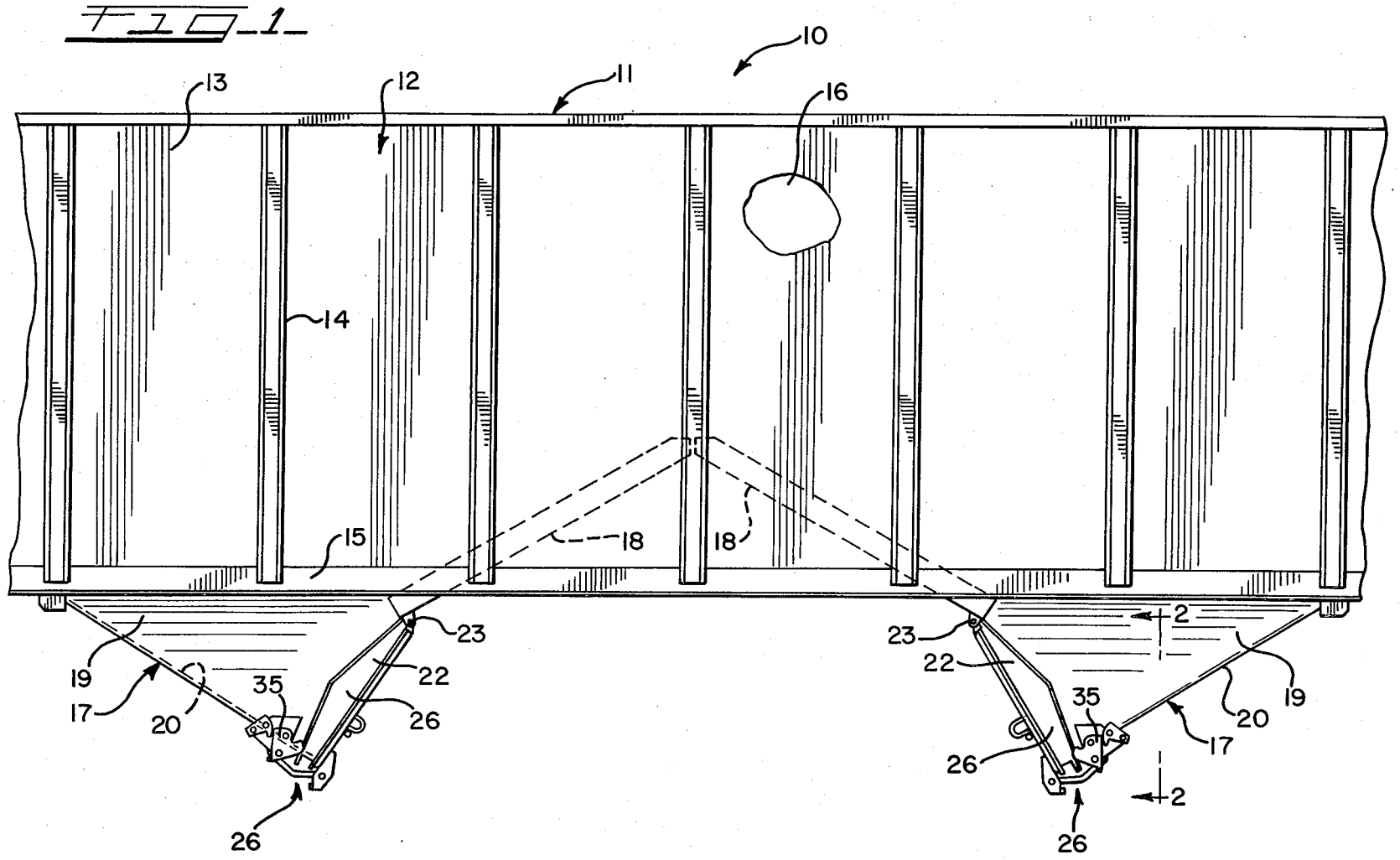
FIG. 1 is a side elevational view of a portion of a hopper car embodying the invention.

Referring particularly to FIG. 1 a hopper car 10 includes a body 11 with side walls 12. Only a portion of the hopper car 10 has been shown, the same including of course the usual underframe structure, wheel trucks, and couplers. The side walls 12 include sheathing 13, vertically extending side posts 14 and lower side sills 15. The interior 16 receives material such as coal or other comminuted materials which is dumped into the open top of the hopper car for transit and subsequent dumping at its destination.

The hopper car 10 includes a plurality of hopper structures 17 which extend substantially transversely and project below the hopper car 10. Each of the hopper structures 17 is adjacent to downwardly extending inner slope sheets 18 provided within the body 10 of the car. Similar end slope sheets are provided at opposite ends of the car, these not being shown. The hopper structure 17 also includes lower side walls 19 and lower slope sheets 20 leading to a discharge outlet 21 provided in a discharge outlet housing generally designated at 26 supported about the side walls 19 and lower slope sheets 20.

Discharge doors 22 are hingedly supported as indicated at 23 on hinge brackets supported from the slope sheets 18 whereby the doors can be moved between open and closed positions. Each of the doors 22 is provided with a hasp 24 and closure bar 25, either of which may be utilized in moving the doors to the closed position from the open position after the material has been dumped.

Referring now particularly to FIGS. 2 through 7, a door locking mechanism generally designated at 26 includes an arm or clevis arrangement or door closure means 27 hingedly connected to each of the doors substantially midway between the opposite lateral ends of the doors. The arm 27 is of clevis shape and includes clevis members 27' which are suitably connected to a transversely extending latch element or jaw engagement element 31 thus forming the clevis-shaped arm 27. Hinge bracket 28 is connected to the lowermost portion of the door 22 and includes a hinge pin 29 which extends through the lower end of the clevis arm 27. The clevis arm 27 is of somewhat arcuate shape and is limited in its downward travel by means of a stop 30 provided on the hinge bracket 28.

Figure 2:
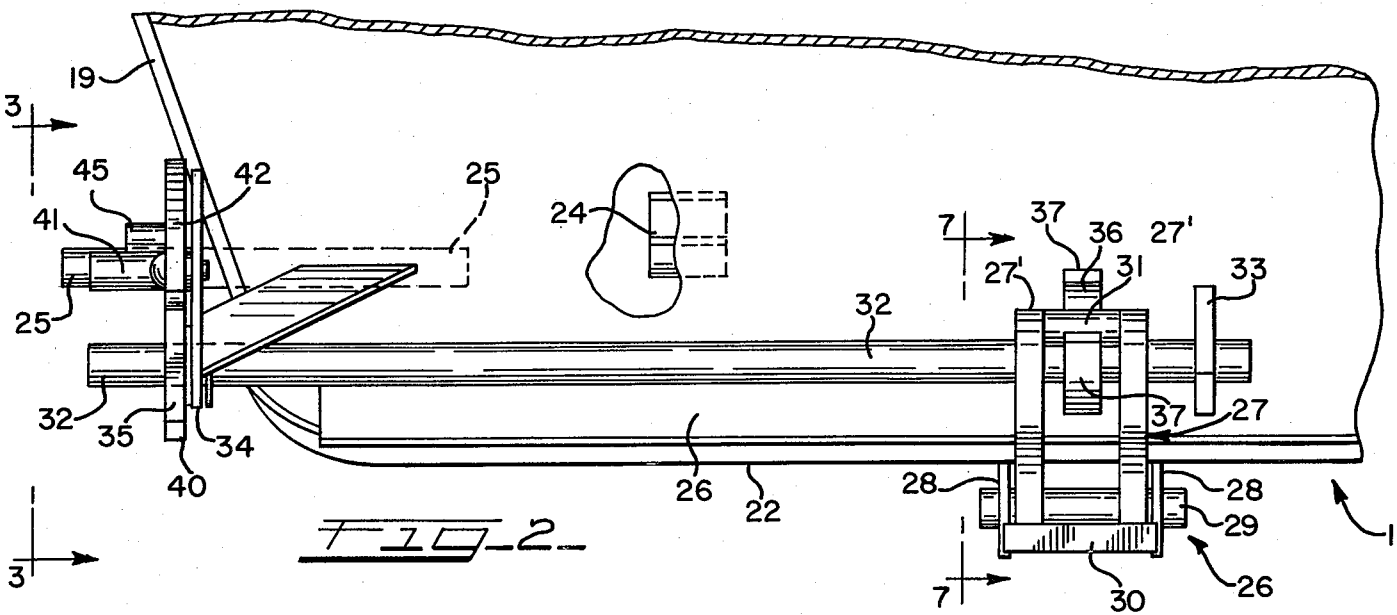
FIG. 2 is a cross-sectional view taken substantially along the line 2—2 of FIG. 1.

The door locking mechanism 26 further includes a transversely extending locking bar or shaft 32 which rotatably connected at one end by means of a bracket 33, as best shown in FIG. 2, and is connected at its outermost ends by means of a bracket 34 which is supported on the side wall 19 of the hopper structure. The bar 32 thus is pivoted for rotation. A locking plate 35 is rigidly connected to the outermost end of the locking bar 32. The locking bar at its other end has connected to for rotation therewith a jaw 36 having a pair of lips 37 opening into a mouth or recess 38.

Figure 4:
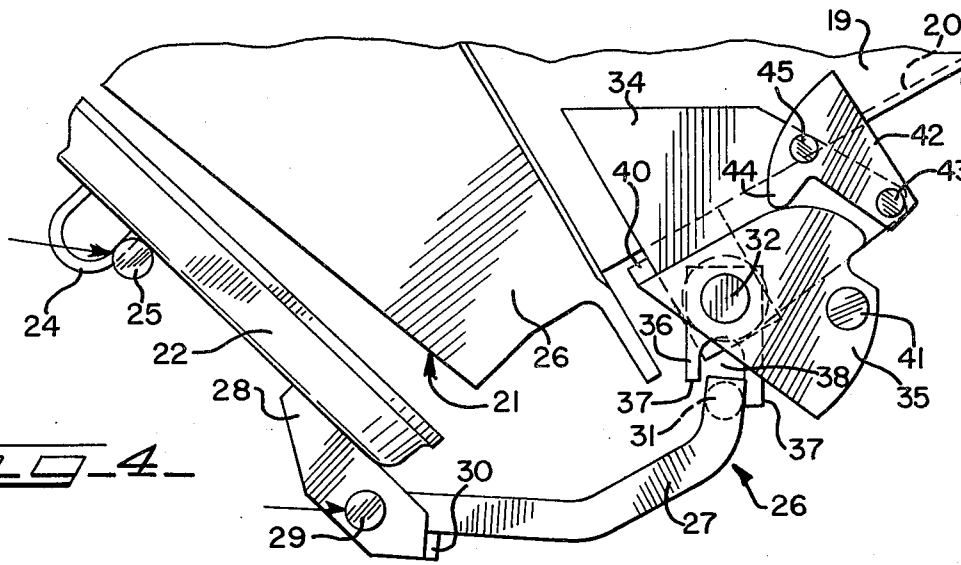
FIG. 4 is a view similar to FIG. 3 showing a locking mechanism for the hopper door structure about to be engaged as it is moved to a closed position.

The locking plate 35 includes a notch or pawl engaging portion 39 and is provided at its lower end with a limit stop 40 as best shown in FIG. 4 which is adapted to engage the pivot bracket 34 in one position limiting further clockwise movement of the locking plate 35 during the operation of the mechanism. The locking plate 35 also is provided with an outwardly extending locking projection or bar 41 spaced laterally from the locking bar 32. A safety pawl is designated at 42 and is pivotally connected at 43 to the pivot bracket 34. The pawl also includes a nose portion 44 and is provided with an outwardly projecting bar 45 as best shown in FIGS. 2 and 4.

OPERATION

Figure 7:
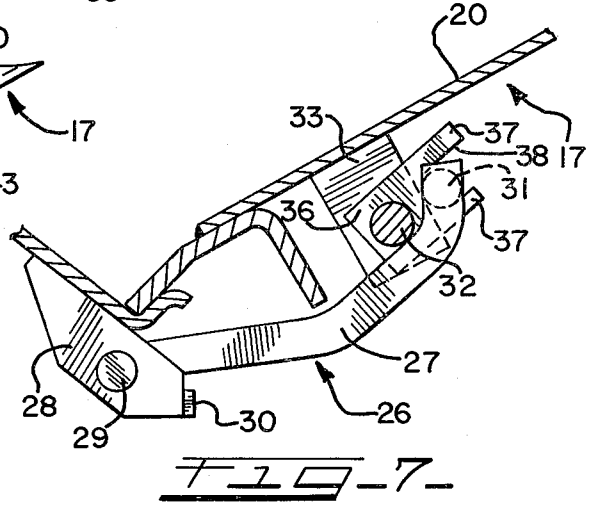
FIG. 7 is a cross-sectional view taken substantially along the line 7—7 of FIG. 2 showing a portion of the door locking mechanism in the closed position.
Figure 5:
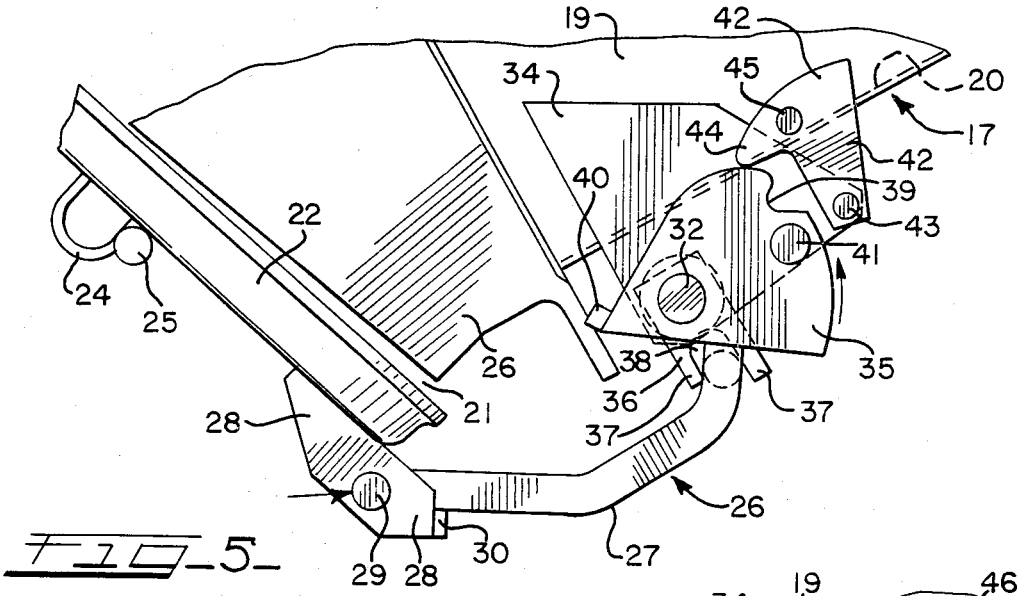
FIG. 5 is another view similar to FIG. 4 showing a further stage in the closing operation.
Figure 6:
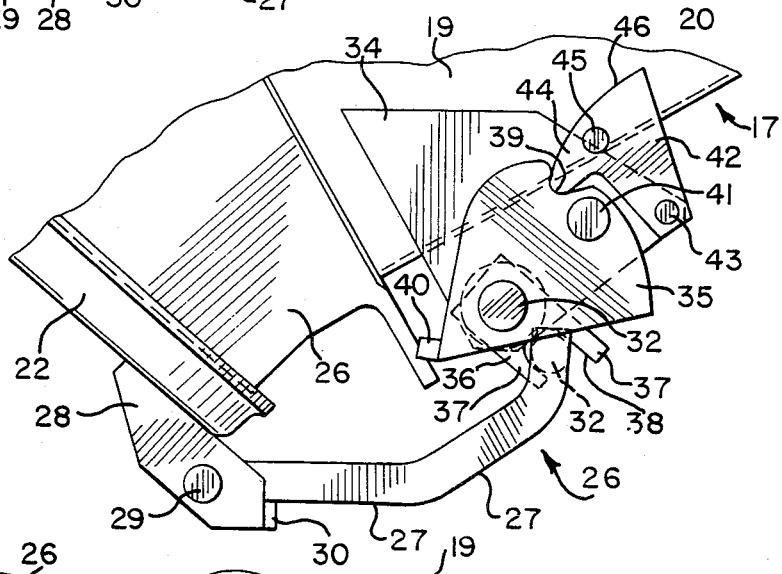
FIG. 6 is a view similar to FIGS. 4 and 5 showing the door in a substantially closed position.
Figure 3:
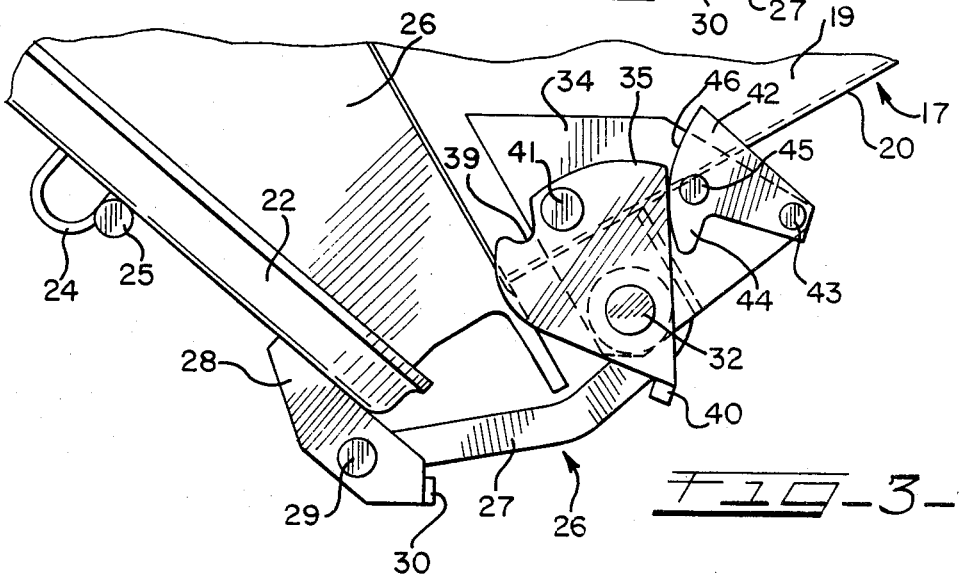
FIG. 3 is a side elevational view of a locking arrangement in locked position taken substantially along the line 3—3 of FIG. 2.

FIGS. 1, 2 and 3 show the closed and locked position of the doors 22. Referring now particularly to FIG. 4 the closing and locking operation of the door will be described. The operator manually grasps the closure bar 25 or inserts a suitable instrument into the hasp 24 and swings the door 22 upwardly into the position shown in FIG. 4. The jaw 36 is in a position to be engaged by the clevis latch element 31 which now enters into the jaw mouth 38 by engaging the longer of the lips 37 and thus being guided into the mouth or recess 38 further closing movement of the door as shown in FIG. 5 causes the jaw 36 and locking plate 35 to pivot in a counterclockwise direction whereupon the stop 40 moves away from the pivot bracket 34. Continued movement of the door to the closed position as shown in FIG. 6 provides for further rotation of the locking plate 35, the rod 32 and the jaw 36 into the position shown in FIG. 6 wherein the latching element 31 is substantially engaged within the mouth 38. At this point the nose 44 of the pawl 42, pivoted on its pivot 43, has engaged the notch or pawl engaging recess 39. Thus the door is in its initially closed position, the pawl temporarily maintaining the latch in said position. The operator now utilizes a pry bar which is inserted between the space provided by the operating rod 32 and the actuating bar 41 and this permits him to exercise a force to further turn the locking plate 35 into the fully locked position which is shown in FIGS. 1, 2 and 7. In order to now fully lock the arrangement in position wherein the safety pawl is fully engaged in its functional arrangement as shown in FIG. 3 the operator continues by the utilization of the pry bar to further rotate the locking plate 35 in the counterclockwise direction whereupon the upper surface 46, best shown in FIGS. 5 and 6, engages a side of the plate 35 completely in locking engagement. Thus the locking plate 35 and related mechanisms are positively locked against any inadvertant release and the safety pawl fully functions in this operation.

To release the mechanism it is a simple matter to utilize a pry bar to insert the same between the bar 45 and bar 41 for pivoting the safety pawl clockwise out of the position shown in FIG. 3 whereupon the plate 35 can now be again rotated clockwise to the open position shown in FIG. 4 and the door swung open by virtue of its own weight and the load carried within the hopper. The present invention provides for mounting the clevis latch in the center between the opposite ends of the hatch doors. By this center arrangement the invention provides a mechanism which can be operated by one man, which dispenses with the relatively complex locking arrangements heretofore known. Additionally, the safety pawl falls into position automatically making it impossible for the operator to forget to place the same in position. The overcenter feature which is shown as the jaw reaches the position indicated in FIG. 7 also assures positive locking of the mechanism and thus further obviates the possibility of inadvertant dumping of the load as well as tightens the seal of the door to prevent the loss of fine material.

Having thus disclosed the preferred embodiment of the invention it will be understood by those skilled in the art that various other forms of the invention will come within the scope of the amended claims.

I claim:

1. In a hopper structure for a railway hopper car, the structure having an outlet opening and a door pivoted at its upper edge to the structure and positioned to close said opening, the improvement of a door locking mechanism comprising, a locking arm connected to said door and projecting outwardly with respect thereto, a latching element on said locking arm, a latching mechanism on said door including a jaw mounted on said hopper structure to one side of said opening, a locking shaft connected to said jaw, said jaw being fixedly mounted on said shaft, means pivotally mounting said locking shaft and said jaw on said hopper structure, a locking plate fixedly mounted on said locking shaft for constrained movement therewith and spaced from said jaw, a pawl pivotally supported on said hopper structure, said locking plate having a pawl engageable portion therein, said door being swingable from an open position whereby said latching element initially engages said jaw to pivot the same and said locking shaft and said locking plate in one direction wherein said pawl is engaged by said pawl engageable portion and said door is held in a closed position, and means on said locking plate engageable by the insertion of a tool for further pivoting said locking plate in said one direction wherein said jaw moves said latching element to a locked position relative to said locking shaft to lock said locking arm.

2. The invention in accordance with claim 1, and said pawl having a locking portion engaging said locking plate in said locked position to maintain the same against opening pivotal movement.

3. The invention in accordance with claim 1, and said arm and latching element comprising a clevis.

4. The invention in accordance with claim 3, and said jaw having a recessed opening engageable with said clevis.

5. The invention in accordance with claim 4, and said door having a lower edge, said clevis having a pivotal connection to said lower edge of the door.

6. The invention in accordance with claim 5, and a pivot bracket having a stop limiting the pivotal movement of said clevis.

7. The invention in accordance with claim 1, and said locking arm, latching element and said jaw being positioned intermediate the laterally opposite ends of said hopper structure and said door, and said locking shaft extending outwardly from said locking arm and said locking plate being connected to said shaft adjacent to an outer edge of said hopper structure and said door.

8. The invention in accordance with claim 7, and said means pivotally mounting said locking shaft on said hopper structure including a pivot bracket positioned adjacent said outer edge, and stop means on said locking plate engageable with said pivot bracket for retaining said plate against pivotal movement in a second direction.

9. The invention in accordance with claim 1, and said arm and latching element being in the shape of a clevis and said arm being of generally arcuate configuration.

10. The invention in accordance with claim 9, and said jaw having spaced lips providing a recess for engaging said latching element, one of said lips projecting outwardly a distance greater than the other.

11. A hopper structure for a railway hopper car, including a hopper having an outlet opening and a door having its upper edge pivotally connected with the hopper and positioned to close said opening and having an imroved door locking mechanism for locking the door to the hopper and comprising, door closure means connected with said door and projecting outwardly with respect thereto and having a jaw engaging element, locking means on the hopper adjacent the door opening and including a pivotally mounted locking shaft having mounted in spaced positions thereon a jaw member and a locking member with a pawl engageable portion and said members being constrained for movement with the locking shaft and said locking means further including a pawl engageable with the pawl engageable portion, said door being swingable from an open position towards a closed position whereby said jaw engaging element is positioned to initially engage said jaw member to pivot said locking member into engagement with said pawl wherein said pawl is engaged by said pawl engageable portion and said door is in a closed position, and operating means on said locking member engageable by insertion of an associated tool for further pivoting said locking member wherein said jaw member moves said jaw engaging element to a locked position relative to said locking shaft to lock said door closure means.

* * * * *